US007896575B2

(12) United States Patent
Schulenberg et al.

(10) Patent No.: US 7,896,575 B2
(45) Date of Patent: Mar. 1, 2011

(54) SOIL COMPACTOR HAVING LOW PROFILE MUFFLER

(75) Inventors: David J. Schulenberg, West Bend, WI (US); Todd J. Lutz, Oconomowoc, WI (US); Jeffrey W. Dujmovic, Milwaukee, WI (US); David J. Waldenberger, Sussex, WI (US); Gary D. Goplen, Stoughton, WI (US); Dawn Auby, Stoughton, WI (US)

(73) Assignee: Wacker Neuson Corporation, Menomonee Falls, WI (US)

( * ) Notice: Subject to any disclaimer, the term of this patent is extended or adjusted under 35 U.S.C. 154(b) by 355 days.

(21) Appl. No.: 12/033,929

(22) Filed: Feb. 20, 2008

(65) Prior Publication Data

US 2009/0208297 A1 Aug. 20, 2009

(51) Int. Cl.
*E01C 19/32* (2006.01)

(52) U.S. Cl. ..... 404/133.1; 404/133.05

(58) Field of Classification Search ..... 404/133.05, 404/133.1; 123/73 AD
See application file for complete search history.

(56) References Cited

U.S. PATENT DOCUMENTS

| | | | | |
|---|---|---|---|---|
| 2,845,050 | A * | 7/1958 | Wacker et al. | 173/46 |
| 6,000,879 | A * | 12/1999 | Greppmair | 404/133.1 |
| 6,019,179 | A * | 2/2000 | Zurbes | 173/49 |
| 6,112,831 | A * | 9/2000 | Gustafsson | 173/162.2 |
| 6,390,034 | B1 * | 5/2002 | Orzal et al. | 123/73 AD |
| 6,698,531 | B2 | 3/2004 | Kurten | |
| 6,758,632 | B2 * | 7/2004 | Hausler et al. | 404/133.1 |
| 2003/0185627 | A1 * | 10/2003 | Hausler et al. | 404/133.1 |
| 2007/0277772 | A1 | 12/2007 | Tanaka et al. | |

FOREIGN PATENT DOCUMENTS

| | | |
|---|---|---|
| JP | 2-125005 | 5/1990 |
| JP | 2001-3310 | 1/2001 |

* cited by examiner

*Primary Examiner*—Raymond W Addie
(74) *Attorney, Agent, or Firm*—Boyle Fredrickson, S.C.

(57) ABSTRACT

A ramming device for compacting soil includes an upper mass and a lower mass. The lower mass is driven linearly back and forth with respect to the upper mass to compact material therebelow. An engine drives the lower mass and is supported by the upper mass. A muffler is fluidly connected to the engine and is contoured such that a majority of the muffler is positioned inboard of a footprint of a side of the ramming device. Preferably, the muffler has a shape that substantially matches a shape of the upper mass adjacent to the muffler thereby further reducing the distance that the muffler extends beyond a footprint of a sidewall of the device.

15 Claims, 5 Drawing Sheets

SOIL COMPACTOR HAVING LOW PROFILE MUFFLER

BACKGROUND OF THE INVENTION

1. Field of the Invention

The invention relates generally to grade compacting devices and, more particularly, to a rammer-type compactor having an exhaust system constructed to be positioned snuggly near the body of the compactor.

2. Description of the Related Art

Compaction is generally performed in preparation of other building processes. Commonly, freshly excavated work sights require compaction of the underlying material, be it soil or gravel, prior to the placement of building materials, such as concrete, over the soil. This compaction can be performed by any of a number of devices including rollers, plate compactors, or rammers. Rammers are a class of compaction device in which an operator can hand-guide a vertically-reciprocating plate or "shoe" over the area to be compacted. The shoe is located on a lower mass driven to reciprocate via a gear crank. The operator's handle is located on an upper mass that is vibrationally isolated from the lower mass and that supports an engine that powers the gear crank. The compact, relatively light nature of rammers, permit them to be guided even if the grade is at a substantial incline or decline. Rammers are also commonly used in trenches or the like due to their compact and generally elongated vertical shape as well as the ease of mobility of such devices in confined spaces. An operator standing in a trench can relatively easily redirect the direction of travel of the rammer with generally minimal interference from the walls of the trench.

A substantial consideration of rammer construction is protection of some of the comparatively fragile components of the rammer assembly from impacts. Commonly, such impacts cause damage due to contact with, debris which may fall from above, or adjacent building materials or structures such as exposed reinforcing rods, etc. Although some such damage may be considered generally cosmetic in nature, such as blemishes to the finish of the machine, other components of the rammer, notably the exhaust system, may be damaged during use.

Rammers are also susceptible to damage during transit. The generally upright orientation of rammers complicates the transportation of such devices. When it is impractical to transport the rammer in its normal, upright position, many users lay the rammer on its side so as to avoid undesired tipping of the rammer. Placement of the rammer in such a horizontal orientation presents an additional opportunity for damage to the comparatively fragile or deformable components of the rammer assembly.

Others have recognized the importance of protecting the lateral surfaces of rammers from damage. Unfortunately, these solutions are not without their respective drawbacks. One such device includes the positioning of multiple guards around the exhaust system and other relatively fragile components of the rammer. The guards are secured to the comparatively robust components of the engine housing and the gear case. Unfortunately, such a configuration communicates the impact loading of the guards directly to components which, if damaged, render the rammer inoperable. That is, an impact that previously would have resulted merely in "cosmetic" damage now has the potential to render the machine unusable due to fractures of either of the engine block or the crankcase.

Such guard systems also undesirably increase the volume occupied by the machine. That is, they increase the space occupied by the machine in storage, during transit, and in use. The guards also increase the weight of the machine, add to manufacturing costs, and complicate maintenance procedures. To mitigate the detrimental weight considerations, some manufactures have formed the guards out of thick-walled aluminum which in turn detrimentally increases the material costs associated with manufacturing the rammer. The guards also must be removed to replace or maintain the components protected by them. Complex fastener assemblies that secure the guards to the machine only further frustrate service efforts.

Guard systems assemblies also commonly include a number of openings to allow adequate airflow into the cavity behind the guard. The air flow is necessary for cooling of machine components and combustion. Unfortunately, the number and size of the openings has the tendency of allowing debris to pass through the guards. The holes also provide the potential for poking damage to the components positioned behind the guard. Roots or other structures may also snag on the holes.

Therefore, there is a need for a rammer that is constructed to protect the deformable systems of the rammer with consideration given to the weight of the machine and the spatial occupation of the machine.

SUMMARY OF THE INVENTION

The present invention provides a rammer compactor that overcomes one or more of the above-mentioned drawbacks. A rammer according to one aspect of the invention includes an exhaust system that is maintained in close association with the body of the rammer and shaped such that at least a majority of the exhaust system is positioned inboard with respect to a line that extends between adjacent portions of the body of the rammer, i.e., the "footprint" of those adjacent structures.

Another aspect of the invention includes a rammer having an upper mass and a lower mass. The upper mass supports the engine and a crankcase that houses a gear train driven by the engine. The lower mass includes a shoe that is reciprocatingly driven by the gear train to engage the material to be compacted. The rammer additionally includes an exhaust for discharging the gases associated with engine combustion. The exhaust is shaped to fit snuggly within a void formed between the engine and the gear case such that the exhaust is protected from damage simply via its shape.

Another aspect of the invention is to provide a rammer that meets the first principal aspect without interfering with the space required for efficient operation of the rammer compactor.

Yet another aspect of the invention is to provide a hand guided rammer that meets the first aspect and that does not otherwise hinder access to the serviceable components of the rammer.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
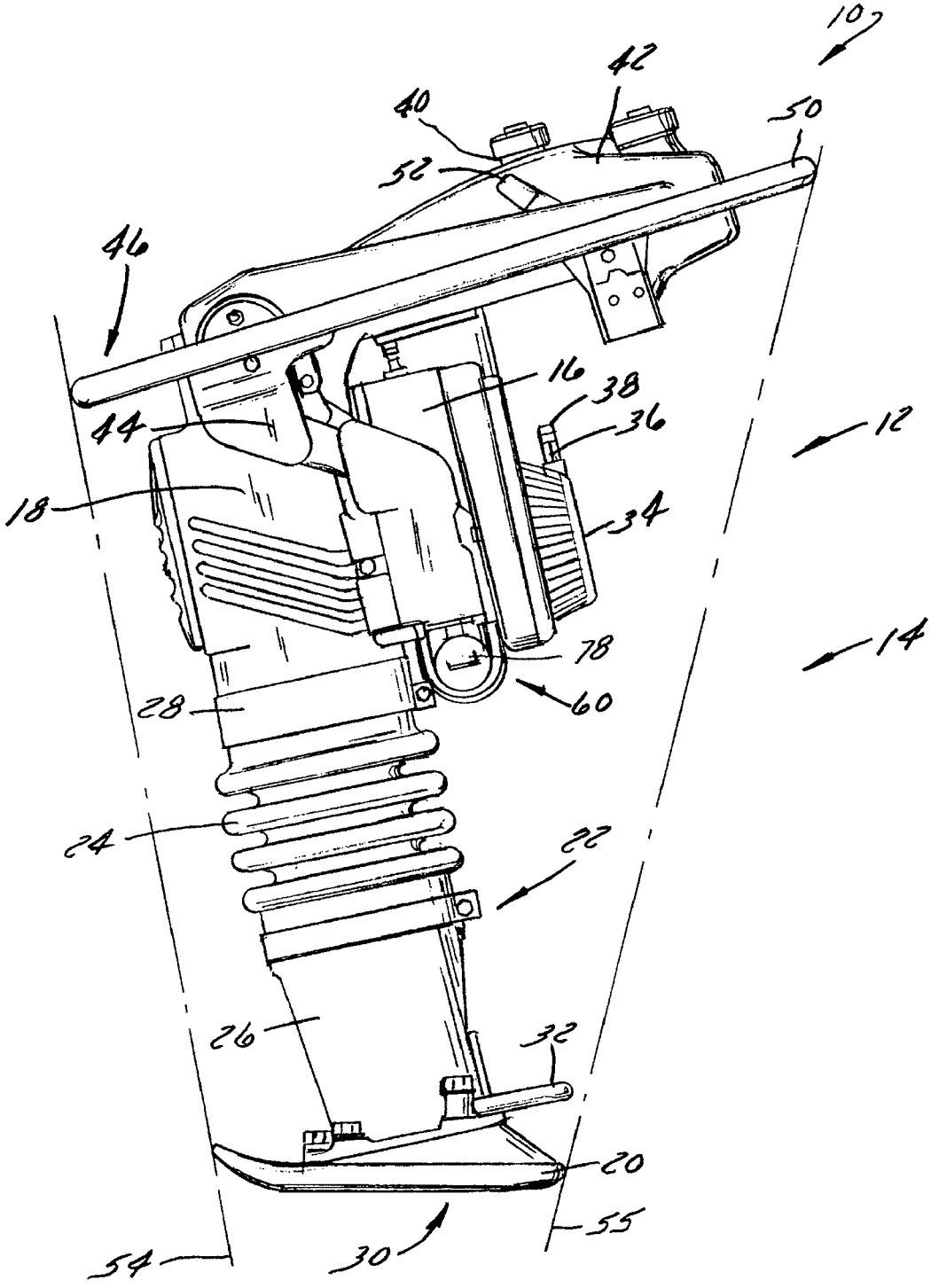
FIG. 1 is a left-side elevational view of a soil compaction device commonly referred to as a rammer and constructed according to the present invention.
Figure 2:
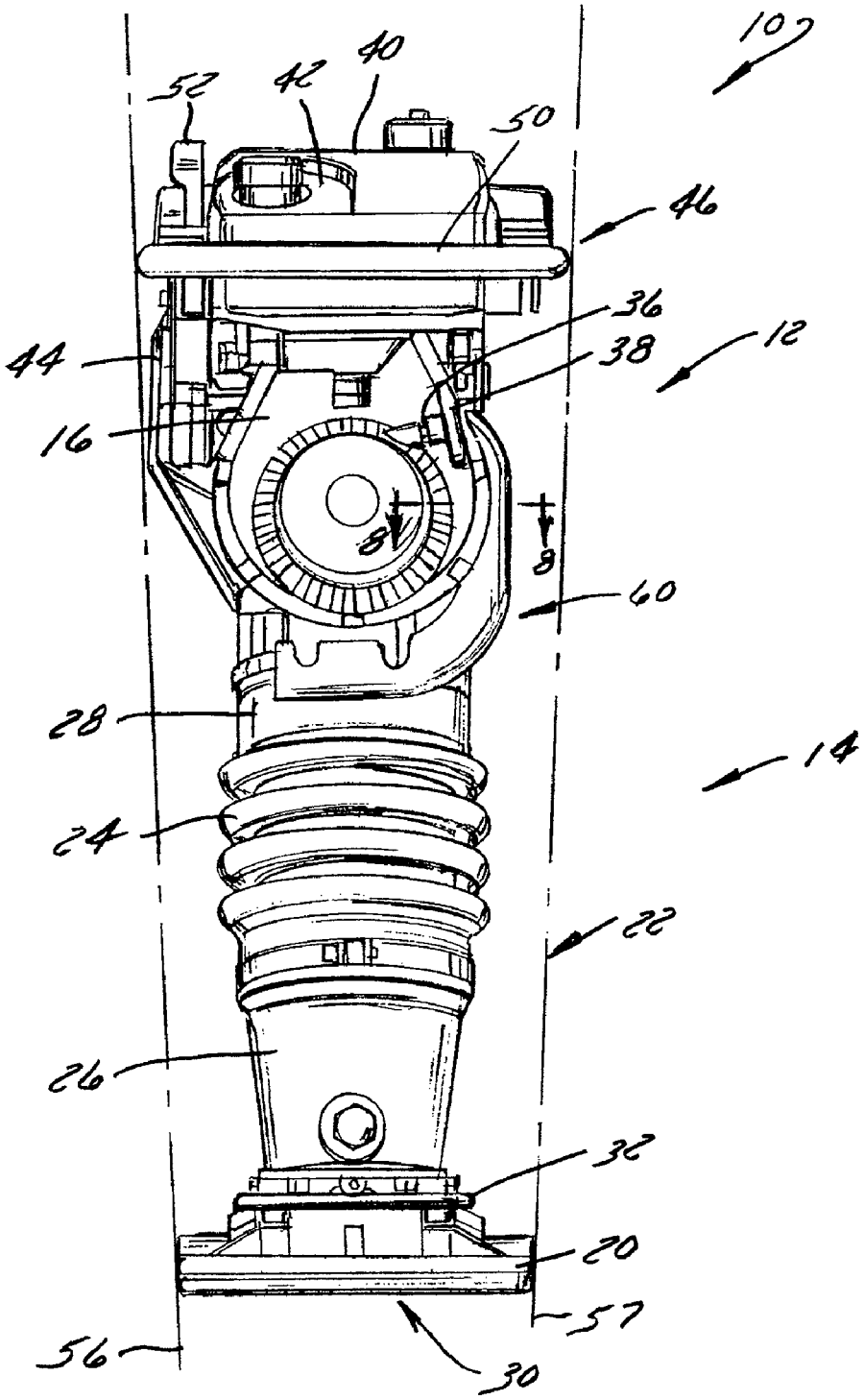
FIG. 2 is a rear elevational view of the rammer shown in FIG. 1.
Figure 3:
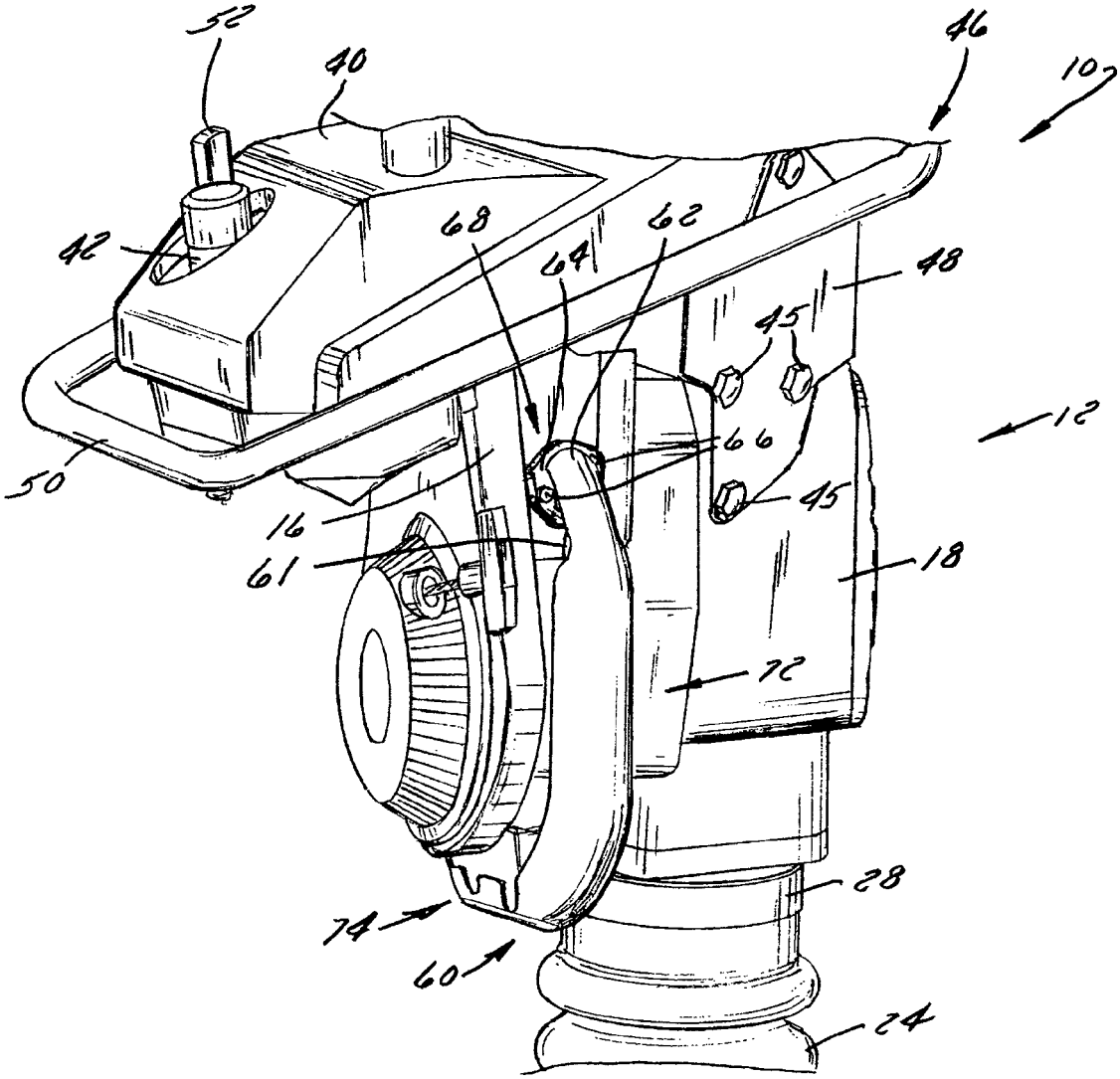
FIG. 3 is rear-right perspective view of the rammer shown in FIG. 2 and shows the exhaust wrapping about the rammer.

FIG. 1 shows a hand guided compaction device or rammer 10 according to the present invention. Referring to FIGS. 1-3, rammer 10 includes an upper mass 12 and a lower mass 14. Upper mass 12 includes an engine 16 connected to a crankcase 18 and lower mass 14 includes a compaction plate or shoe 20 and a spring body 22. Lower mass 14 includes a bellows 24 that extends between a lower spring mount 26 and an upper spring mount 28. Upper spring mount 28 secures lower mass 14 to upper mass 12. Spring body 22 includes one or more springs that reciprocate in bellows 24 during operation of the gear train positioned in crankcase 18.

Shoe 20 includes a work face 30 that is configured to engage a work material passed thereunder. Preferably, shoe 20 is replaceable and/or interchangeable such that different compaction performances can be achieved. A lower handle 32 is connected to rammer 10 proximate shoe 20 and is helpful in assisting with non-operating transportation of rammer 10. The lower handle 32 is typically used only for transporting the rammer 10.

Upper mass 12 includes a recoil starter 34 that is operationally connected to engine 16. Recoil starter 34 includes a handle 38 connected to a pull rope 36 that facilitates manual starting of engine 16. Alternatively, rammer 10 may be equipped within an electric start feature. Upper mass 12 additionally includes a fuel tank 40 and an oil tank 42 which provide a combustion charge to engine 16 via a delivery system 44. Delivery system 44 could be provided as either a carburetor or a fuel injection system. Although engine 16 is shown as what is commonly understood as a two-cycle engine, as evidenced by the separate oil and fuel reservoirs, it is appreciated that engine 16 could be provided as a four-cycle engine. Understandably, such a configuration would commonly include an oil reservoir internal to the engine which would replace oil tank 42.

Regardless of the specific construction of engine 16, as shown in FIG. 3, a number of fasteners 45 secure a frame member 46 to upper mass 12. Fasteners 45 pass through a flange 48 of frame member 46 and engage crankcase 18. Alternatively, frame member 46 could be constructed to be supported by the block of engine 16. Optionally, a number of bushings, or other shock or vibration dampening structures, may be disposed between flange 48 and crankcase 18 to isolate frame member 46 from vibration of rammer 10.

Frame member 46 includes a handle portion 50 that extends outward from a rearward portion of rammer 10. As used herein, reference to forward or rearward portions of rammer 10 are made with respect to a direction of travel during normal generally vertical operation of rammer 10. A user interfacing with handle portion 50 during operation of rammer 10 is generally positioned rearward of the machine with respect to a normal forward direction of travel of rammer 10. Similarly, the right and left sides of rammer 10 are referred to with respect to a user's left hand and right hand sides when positioned rearward of handle portion 50. In accordance with this orientation, an operator positioned at handle portion 50 can conveniently manipulate a throttle lever 52 that is positioned proximate the user's left hand while maintaining control of rammer 10 with his or her right hand. Furthermore, such an orientation positions the operator generally in line with the direction of travel of rammer 10 such that the rammer can be operated in relatively narrow work spaces.

Preferably, engine 16 and a gear train (not shown) in crankcase 18 are coupled via a centrifugal clutch such that engine 16 will idle without the gear train generating a drive output. Increasing the operating speed of engine 16 through the manipulation of throttle lever 52 couples the drive shaft of engine 16 to the gear train, thereby generating movement of a rammer piston assembly that moves axially within lower mass 14. Movement of the rammer piston assembly drives the shoe 20 up and down, thereby compacting the ground passing under shoe 20 in a ramming type manner.

Referring to FIGS. 1 and 2, a number of reference lines 54, 55, 56, 57 are shown which indicate the outermost "footprint" of respective vertical sides of rammer 10. As shown in FIG. 1, if rammer 10 is positioned on its forward side, indicated by line 54, rammer 10 is supported by frame member 46 and shoe 20. Similarly, if rammer 10 is laid on its rearward side, as indicated by line 55, rammer 10 is also supported by frame member 46 and shoe 20. Similarly, as shown in FIG. 2, rammer 10 is also supported by frame member 46 and shoe 20 if rammer 10 is laid on either of its left or right hand sides, as indicated by lines 56 and 57, respectively. Understandably, perfectly planar support surfaces are often unavailable. Accordingly, although supporting rammer 10 by one of shoe 20 and a combination of shoe 20 and frame member 46 is desired, less desirable positioning often occurs. Accordingly, rammer 10 is constructed to withstand periodic impacts at points between frame member 46 and shoe 20, at least with respect to the exhaust side of rammer 10.

As shown in FIGS. 2-7, an exhaust 60 that, in this case, comprises a muffler, is mounted on the rear surface of the rammer 10. Muffler 60 is one of the components of rammer 10 that is desired to be protected from inadvertent impacts. Impacts to muffler 60 can result in damage to the muffler and/or detrimentally affect operation of engine 16 via undesirable exhaust back-pressures. Pursuant to the invention, the muffler is sized and shaped so that at least the majority of it fits within the "footprint" described above. More specifically, muffler 60 includes a body 61 having an inlet end 62 with a flange 64 position thereabout. A number of fasteners 66 secure flange 64 to an exhaust port 68 of engine 16. Body 61 of muffler 60 includes a first portion 72 and a second portion 74. First and second portions 72, 74 of muffler 60 are oriented in generally crossing directions relative to one another thereby providing for relatively compact spacing of muffler 60 relative to rammer 10. Hence, first portion 72 of muffler 60 is oriented in a generally vertical orientation and extends in a generally downward direction from exhaust port 68. Second portion 74 of muffler 60 is oriented in a generally horizontal orientation and extends generally under engine 16 toward the left hand side of rammer 10.

Figure 4:
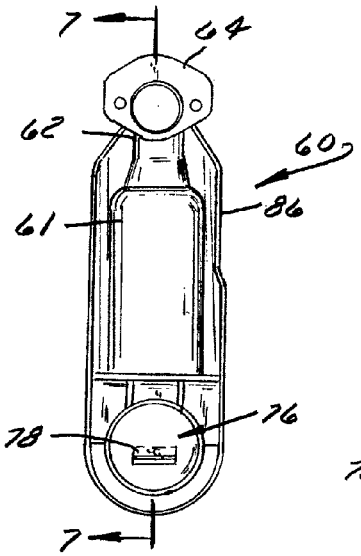
FIG. 4 is a side elevational view of the exhaust shown in FIG. 3 removed from the rammer.
Figure 5:
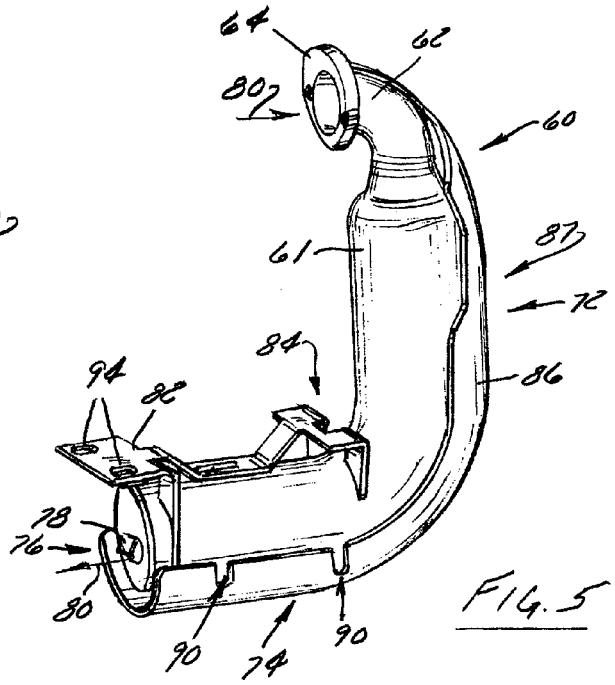
FIG. 5 is a left-rear perspective view of the muffler shown in FIG. 4.

As best shown in FIGS. 4 and 5, muffler 60 includes an exhaust opening 76 having a flange or flap 78 positioned thereabout. Exhaust opening 76 has a generally elongated slot-shape and allows for the expulsion of exhaust gases, indicated by arrow 80 proximate exhaust opening 76 in FIG. 5, from muffler 60. Flap 78 reduces the potential of foreign particles entering muffler 60 and directs the exhaust gases away from engine 16 and the operator.

Figure 7:
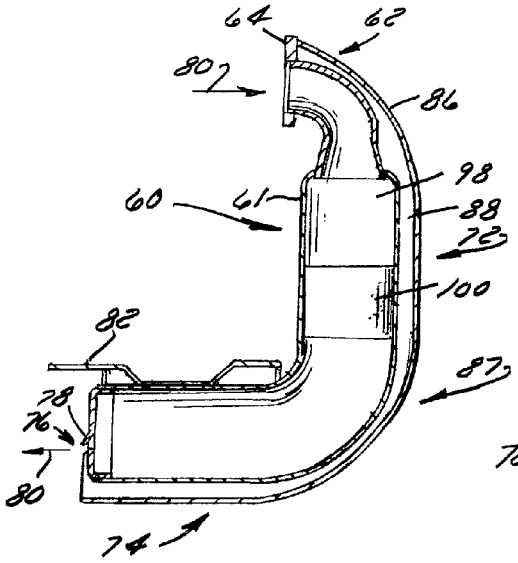
FIG. 7 is a cross-sectional view of the muffler taken along line 7-7 shown in FIG. 4.
Figure 6:
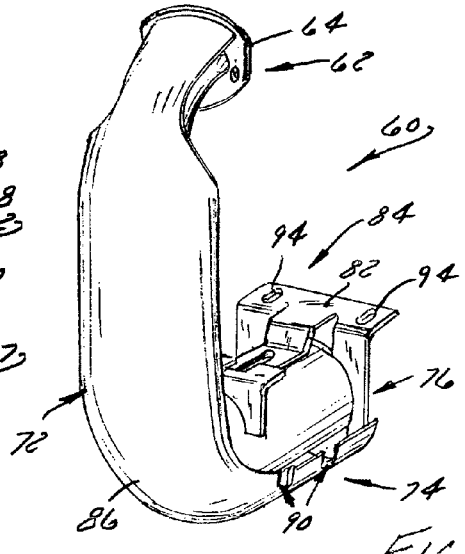
FIG. 6 is a right-front perspective view of the muffler shown in FIG. 5.

Referring to FIGS. 5-7, a mounting flange 82 extends from an inboard side 84 of body 61 of muffler 60 whereas a shroud 86 extends from an outboard side 87. (As used herein, inboard refers to that portion of muffler 60 that generally faces adjacent structure of rammer 10 whereas outboard refers to that portion of muffler 60 that faces toward the operating environment.) Shroud 86, preferably formed from a light-weight resilient material, such as plastic or a generally thin metal material, is offset from body 61 of muffler 60 such that a space or gap 88 is formed between shroud 86 and body 61 of muffler 60. As shown in FIG. 7, gap 88 provides a degree of thermal isolation between body 61 of muffler 60 and shroud 86, thereby reducing the potential of an operator being burned by a hot exhaust. Gap 88 also allows for deformation of shroud 86 toward body 61 of muffler 60 such that, in the event a foreign object or particle would impact muffler 60, shroud 86 absorbs some or all of the energy associated with the impact. As shown in FIG. 5, shroud 86 includes a number of openings or passages 90 that are oriented to cooperate with mounting structures of muffler 60. That is, passages 90 are sized, shaped, and positioned to allow uninterrupted passage of common tools beyond shroud 86 for servicing and/or mounting muffler 60 to rammer 10.

Referring to FIGS. 4-7, mounting flange 82 includes a number of fastener holes 94 that are aligned with corresponding holes formed in the block of rammer engine 16 when muffler 60 is secured thereto. Understandably, holes 94 could also be configured to correspond with holes formed in crankcase 18 or a combination of holes formed in each of block of engine 16 and crankcase 18. Mounting flange 82 is also vertically offset from body 61 of muffler 60 such that the flange 82 abuts rammer 10 when inlet flange 64 is secured to the exhaust port 68 of engine 16. Such a construction allows muffler 60 to be quickly aligned with and secured to the mating structures of rammer 10. Furthermore, slightly offsetting muffler 60 from the remainder of rammer 10 provides an additional impact absorbing feature in that any impact loading of muffler 60 is communicated to the respective connection points. Alternatively, where an even more compact absorption capability is desired, it is appreciated that mounting flange 82 could extend from body 61 of muffler 60 such that body 61 is maintained in very near direct contact with engine 16 or crankcase 18.

Referring now to FIG. 7, exhaust gas 80 enters muffler 60 at inlet end 62, traverses the passages associated with first portion 72 and second portion 74, and is expelled from muffler 60 at exhaust opening 76. Flap 78 directs exhaust gas 80 is a direction downward and away from an operator. Optionally, an exhaust gas passage 98, or that volume defined by body 61 between inlet end 62 and exhaust opening 76, is wholly or partially traversed by an optional catalyst 100. Optional catalyst 100 converts one or more of the less desirable constituents of the exhaust gas mixture to a less environmentally detrimental composition. It is further appreciated that optional catalyst 100 could be configured to be replaceable or sized to be operable for a designed operating life of rammer 10.

Figure 8:
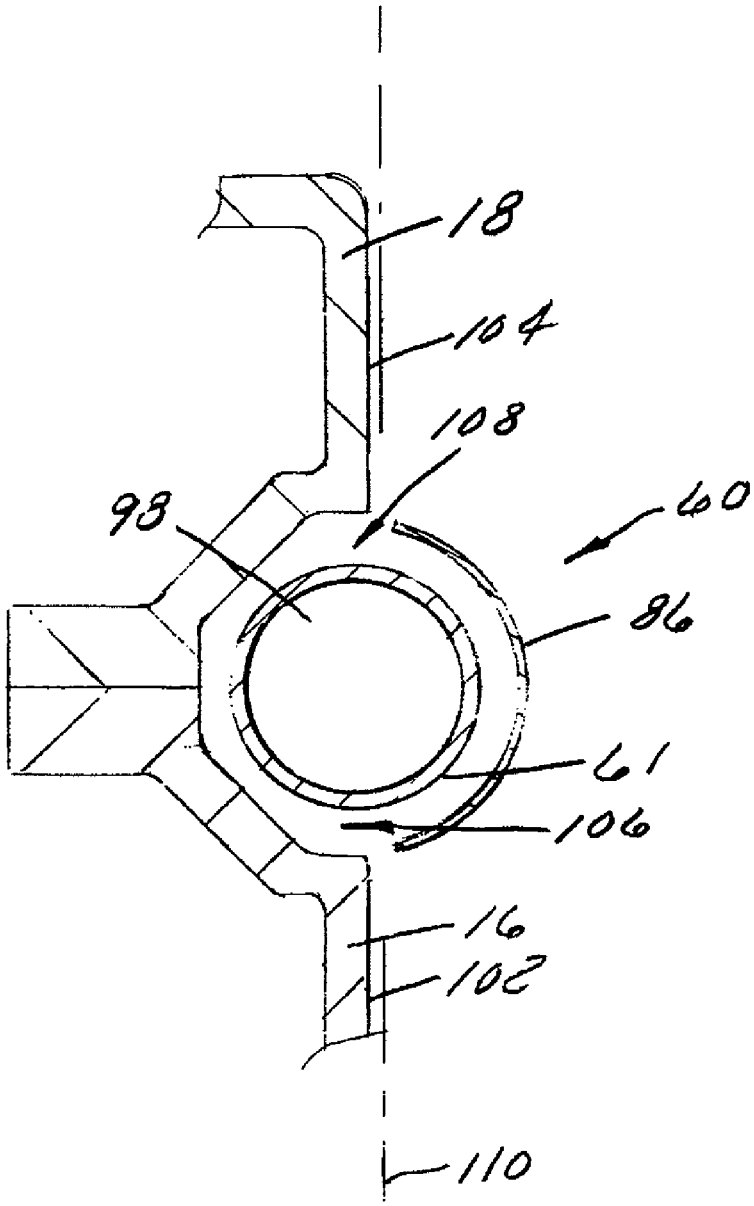
FIG. 8 is a partial cross-sectional view of the rammer shown in FIG. 2 taken along line 8-8 proximate the muffler.

Referring to FIG. 8, engine 16 and crankcase 18 each have an exterior surface 102, 104, respectively. Engine 16 and crankcase 18 are constructed such that, when connected, a void or cavity 106 is formed proximate the interface of engine 16 and crankcase 18. Muffler 60 is constructed to be snuggly received within cavity 106 such that at least a substantial portion 108 of muffler 60 is positioned inboard of a line 110 that is tangent to both the exterior surface 102 of engine 16 and the exterior surface 104 of crankcase 18. Preferably, muffler 60 is constructed such that at least a majority of the cross-section of the vertical first portion 72 of muffler 60 is positioned in cavity 106. Referring to FIGS. 2 and 8, in the event an obstruction passes inboard of line 57 shown in FIG. 2, exhaust gas passage 98 of muffler 60 is protected from collapse by both shroud 86 and the snug positioning of muffler 60 inboard of the adjacent contours of engine 16 and crankcase 18.

Hence, rammer 10 is constructed with multiple features for protecting the operational integrity of the muffler 60. Furthermore, these protection protocols do not overly complicate the serviceability of the rammer. Therefore, the inventive system reduces the potential of inadvertent damage to the deformable components of the rammer without unduly complicating servicing and/or maintenance of such components.

It is appreciated that many changes and modifications could be made to the invention without departing from the spirit thereof. Some of these changes, such as its applicability to rammers having two or four cycle engines, are discussed above. Other changes will become apparent from the appended claims. It is intended that all such changes and/or modifications be incorporated in the appending claims.

What is claimed is:

1. A hand-guided compaction device comprising:

a first mass having an engine;

a second mass that is moveable relative to the first mass to compact materials contacted by the second mass; and an exhaust comprising:

an inlet connectable to an exhaust outlet of the engine;

an outlet vented to atmosphere;

a body forming an exhaust passage between the inlet and the outlet, the body having a shape and contour that generally corresponds to a shape and contour of a void formed within a lateral footprint of the compaction device and between the engine and a crankcase, the void shaped so that a majority of a vertical portion of the body is positioned inboard relative to a line that is tangent to the engine and the crankcase and that crosses the void, and such that a majority of the body is within the lateral footprint of the device; wherein the body having a first portion and a second portion, the first portion extending in a direction that is generally aligned with a longitudinal axis of the compaction device and the second portion extending in an inboard crossing direction relative to the first portion.

2. The compaction device of claim 1, further comprising a catalyst contained in the body and generally traversing the exhaust passage.

3. The compaction device of claim 1, further comprising a shroud positioned outboard of the body and having a contour that generally corresponds to the contour of the body.

4. A compaction device comprising:

an engine;

a crankcase housing a gear train that is driven by the engine;

a lower unit attached to the crankcase for engaging a work material; and an exhaust for discharging combustion gases, the exhaust having a first portion that is nearer an exhaust port of the engine and that extends in a direction aligned with a longitudinal axis of the compaction device and a second portion that is downstream from the first portion and that extends at an angle from the first portion so that the second portion crosses the longitudinal axis of the compaction device, and wherein the exhaust fits-entirely within a footprint of a side of the compaction device and substantially entirely within a cavity defined by a line that is tangent to both a radially outermost exterior surface of the engine and a radially outermost exterior surface of the crankcase.

5. The compaction device of claim 4, further comprising a shroud attached to the exhaust and positioned outboard of the exhaust.

6. The compaction device of claim 5, further comprising a mounting bracket extending inboard from the exhaust.

7. The compaction device of claim 6, wherein the shroud includes at least one access port for allowing access to a respective connecting point of the mounting bracket.

8. The compaction device of claim 4, wherein the exhaust further comprises a generally smooth curve between the first portion and the second portion such that the second portion extends inward relative to the first portion.

9. The compaction device of claim 4, further comprising a catalyst disposed across at least a portion of a flow path through the exhaust.

10. A compaction rammer comprising:

an upper unit having an engine and a crankcase;

a lower unit attached to the upper unit and housing a spring; and an exhaust connected to the engine and being positioned such that a majority of the exhaust is positioned inboard relative to a plane that is tangential to the engine and the crankcase, wherein the exhaust has a generally vertical portion and a generally horizontal portion with respect to an operating orientation of the compaction rammer, and wherein the generally horizontal portion of the exhaust extends to at least a longitudinal center-line of the compaction rammer.

11. The compaction rammer of claim 10, further comprising a catalyst disposed in the exhaust and exposed to a gas flow therethrough.

12. The compaction rammer of claim 10, wherein an entirety of the exhaust lies inboard with respect to a plane that is tangential to upper and lower outermost points of the rammer.

13. The compaction rammer of claim 10, further comprising a shroud positioned generally outboard of the exhaust and having a shape generally similar to a shape of the exhaust.

14. The compaction rammer of claim 13, further comprising a plurality of holes formed in the shroud, each hole associated with a fastener for securing the exhaust to the rammer.

15. A compaction device comprising:

an engine;

a crankcase housing a gear train that is driven by the engine;

a lower unit, attached to the crankcase, for engaging a work material;

an exhaust for discharging combustion gases, the exhaust shaped to fit entirely within a footprint of a side of the compaction device; and a catalyst disposed across at least a portion of a flow path through the exhaust.

* * * * *